US005652991A

United States Patent [19]

Kashani

[11] Patent Number: 5,652,991

[45] Date of Patent: Aug. 5, 1997

[54] HAIR BRUSH CLEANER AND SANITIZER

[76] Inventor: Fataneh Kashani, 5901 Montrose Rd. #N1304, Rockville, Md. 20852

[21] Appl. No.: 519,960

[22] Filed: Aug. 28, 1995

[51] Int. Cl.[6] ..... A46B 13/00

[52] U.S. Cl. ..... 15/38

[58] Field of Search ..... 15/38, 39, 88.2, 15/88.3; 422/292; 206/363, 370

[56] References Cited

U.S. PATENT DOCUMENTS

| | | | |
|---|---|---|---|
| 581,407 | 4/1897 | Oldham | 422/292 |
| 815,313 | 3/1906 | Sweeney | 422/292 |
| 2,082,991 | 6/1937 | Turco | 15/39 |
| 2,704,374 | 3/1955 | Barklow | 15/39 |
| 2,809,406 | 10/1957 | Walter | 422/292 |
| 3,058,134 | 10/1962 | Wozniak-Rennek | 15/38 |
| 3,126,247 | 3/1964 | Miller | 15/39 |
| 3,327,337 | 6/1967 | Nelson | 15/39 |
| 3,375,057 | 3/1968 | Morris | 422/292 |
| 3,879,787 | 4/1975 | Russo | 15/39 |
| 3,982,296 | 9/1976 | Russo | 15/39 |
| 4,034,432 | 7/1977 | Sullivan | 15/88.2 |
| 4,403,364 | 9/1983 | Schroeder | 15/38 |
| 5,435,036 | 7/1995 | Hedrick | 15/88.3 |

*Primary Examiner*—David Scherbel
*Assistant Examiner*—Randall Chin
*Attorney, Agent, or Firm*—Harvey Kaye; Jerry Cohen

[57] ABSTRACT

A hair brush cleaner and sanitizer, having a hair remover section for removing hair from hair brushes placed into it. The hair remover section includes a pair of shafts with hair removing tines thereon, the shafts being mounted to rotate in opposite directions in such manner that the tines move between the hair brush bristles during operation, a motor for rotating the shafts, a drive train connected between the motor and the shafts to rotate the shafts in opposite directions, and switch means for actuating the motor for a predetermined period of time when it is desired to clean a hair brush located in the hair remover section by the moving tines contacting or moving between the bristles of a hair brush to remove hair therefrom. The device also includes a sanitizing section for sanitizing the hair brush and including a removable jar with a sanitizing solution disposed therein with an opening at the top of sufficient size to allow a hairbrush to be placed therein. The device further includes an ultra violet drying and sanitizing section including at least one light and switch means for actuating the light for a predetermined period of time when it is desired to sanitize a hair brush located therein. Also, means can be provided for mounting the device slidably under a counter so that it can be slid out from under the counter so an operator can obtain access thereto.

4 Claims, 4 Drawing Sheets

HAIR BRUSH CLEANER AND SANITIZER

FIELD OF THE PRESENT INVENTION

The present invention relates generally to the cleaning and sanitizing art, and, more particularly, to a hair brush cleaner and sanitizer.

BACKGROUND OF THE INVENTION

U.S. Pat. No. 1,255,072 discloses a comb cleaner in which rollers with bristles are used.

U.S. Pat. No. 2,121,307 discloses a cleaning and sterilizing device for dental equipment in which rubber bristles clean the instrument as it is inserted into the device.

U.S. Pat. No. 2,701,376 discloses a brush cleaning apparatus in which a brush is moved through and along a horizontal slot and is first acted upon by spikes and then by bristles.

U.S. Pat. No. 3,072,939 discloses a hair brush cleaner in which the brush is inserted horizontally into the device and then removed and while inside fingers rotate between some of the bristles of the brush to be cleaned.

U.S. Pat. No. 3,348,253 discloses a hairbrush or comb cleaner in which a horizontally positioned hairbrush is cleaned by rotating brushes to remove hair.

U.S. Pat. No. 3,377,646 discloses a device for cleaning hairbrushes and combs in which the hairbrush is cleaned by a single set of bristles and currents of air and then is placed into a chamber for cleaning and drying.

German Auslegeschrift No. 1,295,774, disclosed May 22, 1969) discloses a comb and hair cleaning device in which the brushes are placed vertically into the device and vibrated.

U.S. Pat. No. 3,805,318 discloses a hair brush cleaning device having a rotatable brush roller having fingers engaging the bristles of the brush to be cleaned.

Russian Patent No 485107 of Dec. 25, 1979, with a reciprocating holder to Mitrofanov SA, discloses a washing unit for hairbrushes in which the hairbrush is moved with respect to a cleaning solution.

BRIEF SUMMARY OF THE INVENTION

It is a main object of the present invention to provide a hair brush cleaner which performs more efficiently and is smaller than those of the prior art.

One object of the present invention is to provide a hair brush cleaner which is of small size, easy to carry, easy to make its three sections separately, and can be used on a station work surface or attached under the station surface.

Another object is to provide a device of the type described in which at the same device the hair stylist can remove hair from the brush by the device and sanitize the brushes using a solution and with an ultra violet light section.

A further object of the invention is to provide a device of the type described in which only two of the three sections are used; for example the hair brush cleaner and the sanitizing solution can be used without the UV section if desired. The UV section can be attached to the device when desired but is not required to be used.

The present invention provides a hair brush cleaner device which can be customized for each station in hair salons.

Other objects, features and advantages will be apparent from the following detailed description of preferred embodiments taken in conjunction with the accompanying drawings in which:

DETAILED DESCRIPTION OF THE DRAWINGS

Figure 1:
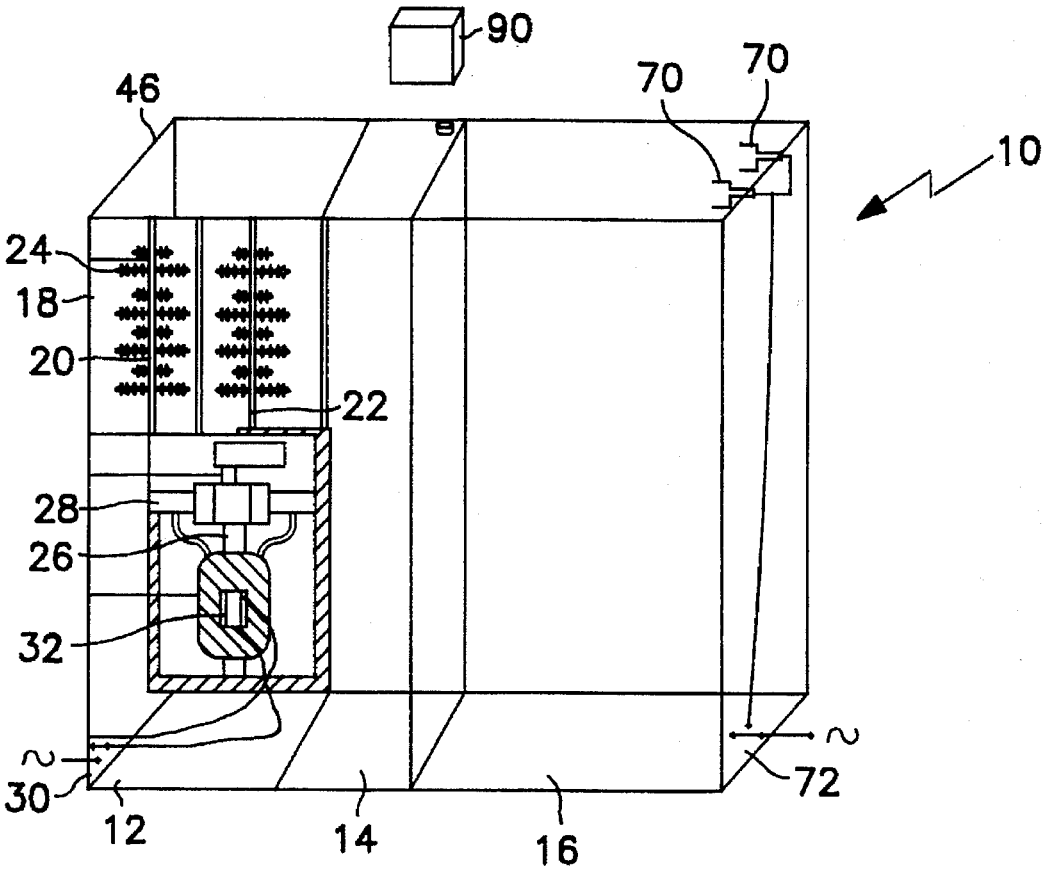
FIG. 1 is a diagrammatic isometric view of the complete hair brush cleaner of the present invention.
Figure 1A:
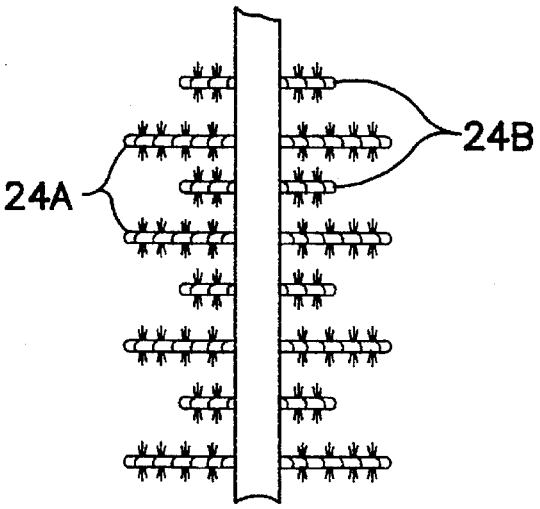
FIG. 1A is a schematic view of the shaft carrying two different size cleaning tines.

The present invention can, in one embodiment as shown in FIG. 1, comprise a triple compartment housing 10 in which there is a first section 12 for cleaning the hair from brushes, a second section 14 which includes a solution for disinfecting a hair brush which is dipped into the solution. There is a third section 16 which has ultra violet (UV) lights for further disinfecting the hairbrush.

The first section includes a brush compartment 18 including two spaced brush shafts 20 and 22 with radially extending cleaning fines 24 on them for removing the hair which accumulates on the brush when it is used. The shafts 20 and 22 are rotated to perform the cleaning action. There may be two different sizes of tines. The longer ones 24A are for cleaning the dandruff and the like from the brush, and the shorter ones 24B are for removing the hair from the hair brush. A switch 30 is provided which starts and stops the motor 32 which rotates the motor drive shaft 26 to move the drive train 28 and thus the fines with respect to the hairbrush so that the hair is removed by the two shafts with the stiff tines. If desired, a timer may be used so that the brushes stop rotating after a predetermined period of time which may be set by the user.

Figure 2:
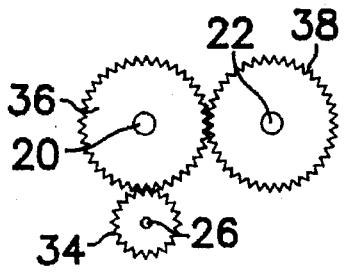
FIG. 2 is a schematic view of a portion of one embodiment of the drive train of the present invention.

Details of one embodiment of the drive train is shown in FIG. 2, and include a pinion 34 on the motor drive shaft which drives gear 36 mounted to first brush shaft 20 and which meshes with gear 38 mounted to second brush shaft 22. Thus, when the motor rotates motor drive shaft 26, pinion 34 rotates with it and in the same rotational direction. This pinion directly drives gear 36 which in turn directly drives gear 38. Thus, when the motor is switched on, it rotates the two brush shafts 20 and 22 in opposite rotational directions. Actually, the shafts are connected through drive wall 44 to first and second drive discs 40 and 42 which are journalled into the wall and are driven by the gears 36 and 38 because they are attached to them respectively. The discs 40 and 42 receive the brush shafts 20 and 22 and drive them.

Figure 3:
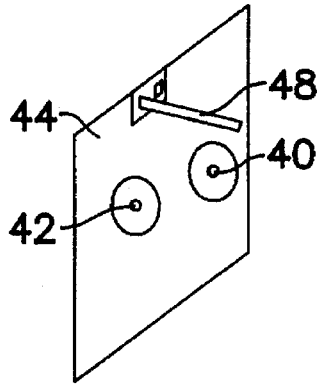
FIG. 3 is a schematic view of a portion of the mounting of the cleaning shafts.
Figure 4:
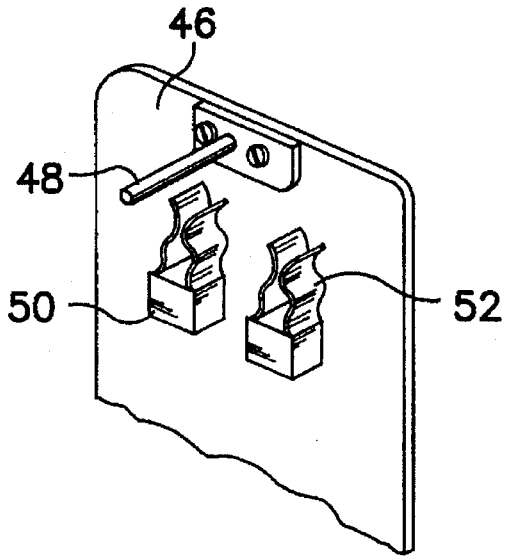
FIG. 4 is a schematic view of the opposite end of the mounting section showing the mounting of the other ends of the cleaning shafts from that shown in FIG. 3.

FIG. 3 shows the wall and the drive discs 40 and 42. In addition, FIG. 4 shows the end wall at the opposite end of the hair brush section from the drive train, including end wall 46. This end wall 46 has a flexible support wire 48 (if desired there may be more than one such wire) extending from it to the drive wall 44 and the wire 48 is mounted in both walls and extends parallel to the brush shafts 20 and 22. The shafts 20 and 22 are rotatably supported by the first and second drive clips 50 and 52. The wire(s) 48 hold the brush in place during operation.

Figure 5:
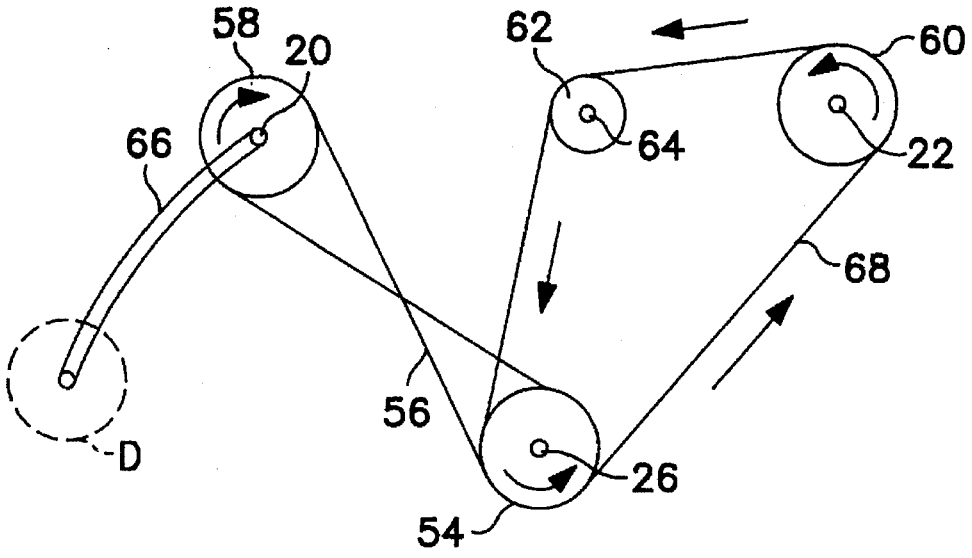
FIG. 5 is a schematic view of the details of another embodiment of the drive train.

FIG. 5 shows another embodiment of the drive train 28 using pulleys and belts. Shaft 26 has two pulleys on it, only one of which can be seen in this Figure. The one which can be seen is pulley 54 which has belt 56 running around its periphery and which is crossed and extends over pulley 58 so that pulleys 54 and 58 turn in opposite directions as do their respective shafts 26 and 20.

Another pulley on shaft 26 cannot be seen, but belt 68 extends around that pulley and also around pulley 60 on shaft 22 and a further pulley 62 on shaft 64 so that the three shafts 22, 26 and 62 turn in the same direction.

As an additional feature, a groove or arcuate slot 66 can be provided for shaft 20 to move along, depending upon the size of the hair brush to be cleaned. A larger hair brush will force the tines on shaft 20 further away from the tines on shaft 22 and the shaft 20 will move along the groove against spring tensions which will be provided by a spring which pushes the shaft 20 toward the position shown in solid lines in FIG. 5. When such a larger brush is used the pulley 58 along with shaft 20 moves to position D shown in dashed lines in FIG. 5.

Figure 6:
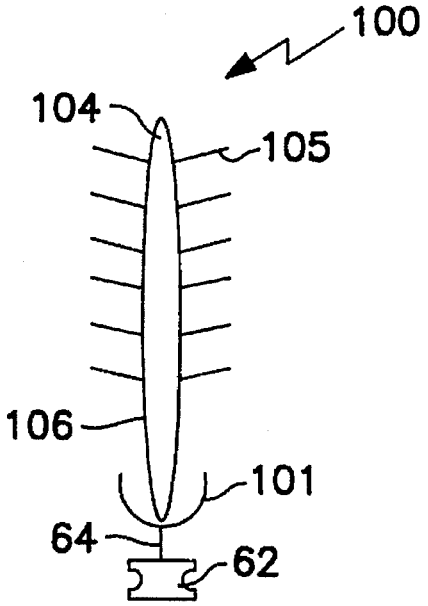
FIG. 6 is a schematic view of the mechanism for rotating the hair brush.

FIG. 6 shows an arrangement in which the bottom or handle 106 of the hair brush 100 having shaft 104 and bristles 105, can be placed into a flexible cup 101 to be retained in upright vertical position and to allow the brush to turn from the movement of the cup 101 which is mounted on shaft 64 which is rotated by the pulley 62 which is driven by belt 68. This assures that all bristles on any portion of the periphery of the brush shaft will be exposed to the cleaning action of the tines.

There can be a hinged door to close the brush cleaning section when it is in operation, and the loose hair which falls to the bottom of this section can be removed after the hair brush is removed from the chamber by using a brush to sweep the hair out, or a vacuum device to remove the loose hair which has been removed from the hairbrush.

After it is cleaned in the brush cleaning section, the hair brush is moved into the sanitizing solution to provide disinfecting action in the disinfectant second section 14 which includes an opening in the housing of the device into which a jar or other container 90 for the sanitizing solution is removably disposed.

Next, the hair brush may be moved into the ultra violet third section 16 for drying and disinfecting using UV lights 56 which may include one or more such lights 56. There is a switch 72 provided to turn these lights on and off when the are to be used. If desired a timer may be used so that the lights will shut off after a predetermined period of time which may be chosen by the user.

This combination provides good cleaning and disinfecting of the brushes which are used.

Figure 7:
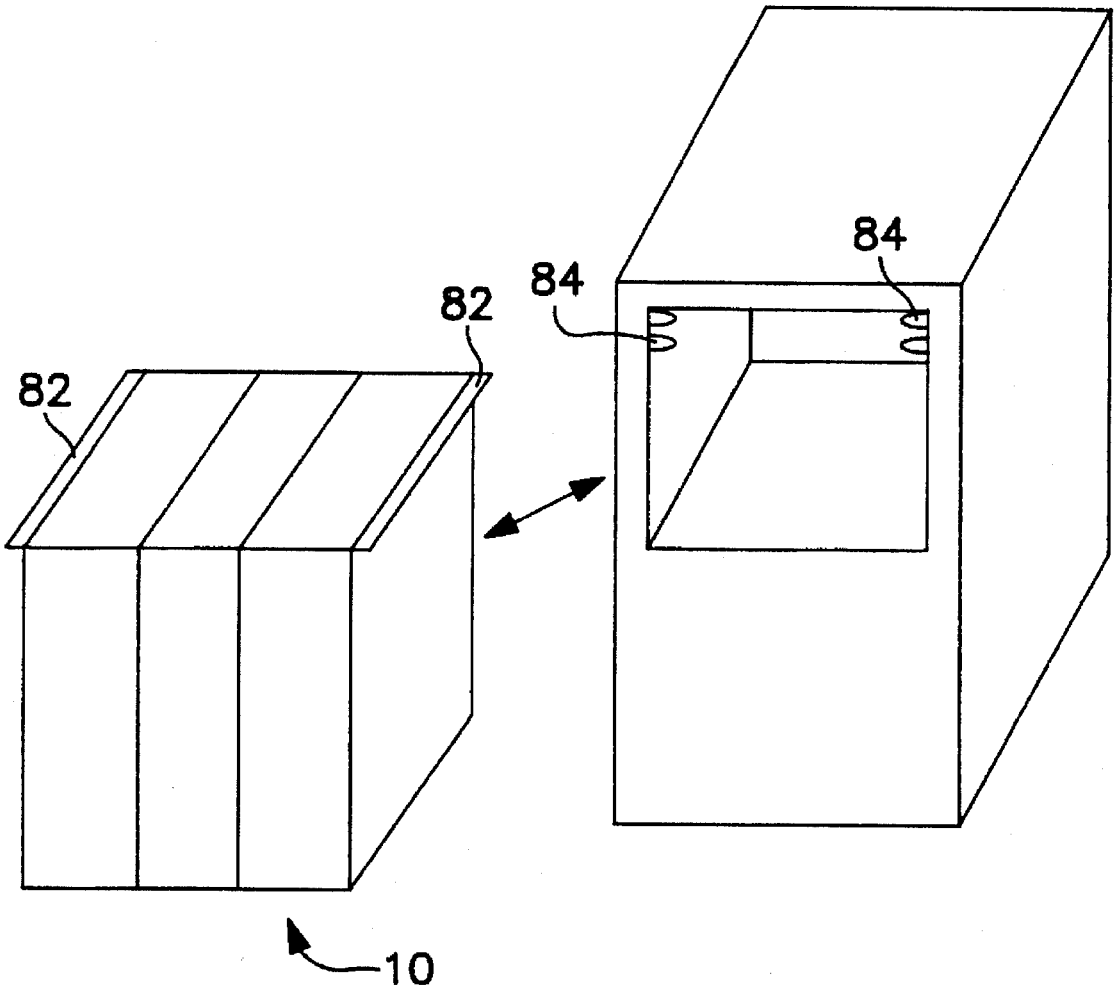
FIG. 7 is a schematic exploded view of the present invention used in an under counter arrangement.

While FIG. 1 shows an embodiment which can sit upon a salon operator's shelf, it is also possible, in a further embodiment, as shown in FIG. 7, to mount the top of the housing onto drawer-type of slides 82 which move in drawer guides 84 so that the housing can be mounted to the under side of the shelf and be pulled out the same as a drawer when the operator wishes to access the device. In this manner, the device takes up no counter space.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

I claim:

1. A hair brush cleaner and sanitizer, comprising:

a. a hair remover section for removing hair from hair brushes placed into it, and including a pair of generally vertically oriented shafts with hair removing tines thereon, at least one of said shafts being driveable to rotate;

b. a sanitizing section for sanitizing the hair brush; and c. an ultra violet sanitizing section, said hair remover section including a motor for rotating said shafts, and a drive train connected between the motor and the shafts to rotate the shafts in opposite directions, said sanitizing section including a removable jar for containing a sanitizing solution and having an opening at the top of sufficient size to allow a hair brush to be placed therein, and said ultra violet sanitizing section including at least one ultra violet light means for mounting said cleaner and sanitizer slidably under a counter so that it can be slid out from under the counter so an operator can obtain access thereto.

2. A hair brush cleaner and sanitizer, comprising:

a. a hair remover section for removing hair from hair brushes having bristles placed into it, and including:

i. a pair of generally vertically oriented shafts with hair removing tines thereon, said shafts being mounted to rotate in opposite directions in such manner that the tines move between the hair brush bristles during operation, ii. means for holding and rotating a hair brush, iii. a motor for rotating said shafts, iv. a drive train connected between said motor and said shafts to rotate said shafts in opposite directions, and to rotate said brush holding means, and v. switch means for actuating said motor for a predetermined period of time when it is desired to clean a hair brush located in the hair remover section by the moving tines contacting or moving between the bristles of a hair brush to remove hair therefrom;

b. a sanitizing section for sanitizing the hair brush and including a removable jar with a sanitizing solution disposed therein with an opening of sufficient size to allow at least one hairbrush to be placed therein; and c. an ultra violet sanitizing section including at least one ultra violet light and switch means for actuating said light for a predetermined period of time when it is desired to sanitize a hair brush located therein.

3. A hair brush cleaner and sanitizer as defined in claim 2, wherein said drive train includes a gear train.

4. A hair brush cleaner and sanitizer as defined in claim 2, wherein said drive train includes pulleys and at least one endless band.

* * * * *